US005082219A

United States Patent [19]

Blair

[11] Patent Number: 5,082,219

[45] Date of Patent: Jan. 21, 1992

[54] DEVICE FOR KEEPING A BAG MOUTH OPEN AND HOLDING THE BAG AGAINST A VERTICAL SURFACE OR A POLE

[76] Inventor: Norman Blair, 202 Old Glenarm Road, Larne, BT 40 1TT, Northern Ireland

[21] Appl. No.: 465,114

[22] PCT Filed: Aug. 5, 1988

[86] PCT No.: PCT/GB88/00648

§ 371 Date: Feb. 15, 1989

§ 102(e) Date: Feb. 15, 1989

[87] PCT Pub. No.: WO89/01441

PCT Pub. Date: Feb. 23, 1989

[30] Foreign Application Priority Data

Aug. 20, 1987 [GB] United Kingdom ..... 8719643

[51] Int. Cl.[5] ..... B65B 67/00

[52] U.S. Cl. ..... 248/99

[58] Field of Search ..... 248/95, 97, 98, 99, 248/100, 101, 229, 311.2; 24/20 R, 20 S, 30.5 P, 484

[56] References Cited

U.S. PATENT DOCUMENTS

| | | | |
|---|---|---|---|
| 199,507 | 1/1878 | Brubaker | 248/100 |
| 260,707 | 7/1882 | Pendleton | 248/100 |
| 497,870 | 5/1893 | Fjellman | 248/99 |
| 796,695 | 8/1905 | Blake | 24/484 X |
| 868,269 | 10/1907 | Hulbert | 248/100 |
| 895,759 | 8/1908 | Hulbert | 248/100 |
| 2,632,934 | 3/1953 | Thompson | 24/20 R |
| 2,639,110 | 5/1953 | Nicolas | 248/99 |
| 3,295,812 | 1/1967 | Schneider et al. | 248/229 |
| 3,532,314 | 10/1970 | Vosbikian | 248/99 X |
| 3,627,243 | 12/1971 | Farrelli | 248/99 |
| 3,916,962 | 11/1975 | Stolt | 141/108 |
| 4,319,726 | 3/1982 | Andersson | 248/99 X |
| 4,543,691 | 10/1985 | Calmettes | 24/20 R |

FOREIGN PATENT DOCUMENTS 801080 12/1950 Fed. Rep. of Germany .

*Primary Examiner*—David L. Talbott
*Attorney, Agent, or Firm*—Zarley, McKee, Thomte, Voorhees & Sease

[57] ABSTRACT

A device holds the mouth of a bag open and may hold the bag against a vertical surface or to a pole. The device comprises an elongate belt which is formed into an annular member by use of sleeves which are attached to the ends of the belt and enable the belt to overlap onto itself. The diameter of the device or annular member is variable. A bag mouth is pulled up through the center of the annular member and the bag's mouth circumference is wrapped over the annular member circumference. The annular member diameter is then increased and the bag clings to the member. The annular member with bag fitted thereon can be held to a vertical surface by a spring clip or to a pole by a spring clip which may be adjusted up or down the pole, the pole being partially pushed into the ground or other stable surface.

1 Claim, 8 Drawing Sheets

37'
37
36
14/15
11
34/35

40
36
39
38
14/15
34/35

DEVICE FOR KEEPING A BAG MOUTH OPEN AND HOLDING THE BAG AGAINST A VERTICAL SURFACE OR A POLE

The present invention relates to a device for retaining a bag mouth open, and is especially but not exclusively for application with bin bags.

When depositing material into a bag, it is inconvenient to continually hold the mouth of the bag open. This function may be fulfilled by placing the bag inside a rigid cylinder such as a bin and folding the bag over the rim, but a bin is neither portable, nor can its mouth size be varied to accommodate different sizes of bags.

A plastic belt is disclosed in U.S. Pat. No. 3,627,243 for use with paper bags and which has to have a separate clamping member which must be manually displaced to lock the belt in position and can only be used with the bag mouth located outwardly thereof and not folded thereover such that the belt may fall out of the mouth and is difficult to position apart from being less easy to use.

An object of the present invention is to provide a means to help readily and automatically retain open the mouth of bags of various mouth diameters.

According to the present invention, there is provided a device to help retain the mouth of a bag open comprising an elongate body having sufficient flexibility to bend over on itself to form an annular member with both ends of the body overlapping each other, and sufficient stiffness to be self-supporting in the condition: means holding at least one of said ends adjustably to the body whereby the diameter of the annulus can be varied by moving the one end along the body relative to the other end.

Also according to the present invention, there is provided a method of helping to retain the mouth of a bag open comprising using a device comprising an elongate body having sufficient flexibility to bend over on itself to form an annular member with both ends of the body overlapping each other, and sufficient stiffness to be self-supporting in this condition: means holding at least one of said ends adjustably to the body whereby the diameter of an annulus can be varied by moving the one end along the body relative to the other end; the mouth of the bag being circumferentially held open by said annular member.

Preferably, said holding means is a sleeve through which the end slides and is held adjacent the body, and advantageously each of the two ends is held adjustably to the body by separate sleeves, the diameter of the annulus being varied by sliding one end and its associated sleeve along the body relative to the other end and sleeve.

The annular member is preferably used with a plastic bin bag or bag or other material, which is ideally suited for collecting litter with a spike for spearing paper. Preferably, a spike discharge member is provided having a notch located over the mouth of the bag for displacing paper from the spike into the bag. Advantageously a handle is provided secured to the annular member to provide a more secure grip, and also when used with the said notched discharge member, to provide an anchor base to which said notched member is secured.

According to another aspect of the invention there is a clip which will hold the elongate body whilst fitted to the bag, to a vertical surface i.e. a wall. This clip may be adjustable on the wall in order to vary the height of the annular member from the ground.

According to another aspect of the present invention a spiked pole which may be pushed into the ground to act as a support pole for the annular member with a spring clip. The spring clip may be adjusted with reference to its position on the pole by means of the application of hand pressure to the clips surfaces and thereby adjusting the height of the annular member from the ground.

The device may be used to locate a bin bag with a bin by resting on the rim thereof.

The length of band or belt should be such that there is sufficient overlap in the circumference of the closed loop in its likely position of use i.e. relative to the circumference of bag with which it is to be used, so that the loop has a tendency to lock or stick sufficiently to prevent contraction of the loop under the compressive reactive action of the material of the bag against which the loop has been expanded. The "self-locking" phenomena or jamming or sticking may be considered as a result of the created curvature of the belt which, apart from possibly causing increased friction of the belt portions against each other, importantly causes an inclination of the portion of the belt in the passage or passages of the sleeve or sleeves and the outwardly exerted pressure by the belt portions therein against the walls of the sleeve passages. It is believed the belt tends to jam in position of use because of its inclination in the passage of the sleeve(s) or other holding means relative to the central axis thereof because of the pressure exerted by the free end of the belt in its sleeve passage which tilts the sleeve and acts to jam the belt. Thus the dimensioning of the width and thickness of the belt, the length of the belt and the width and thickness of the passage(s) through the sleeve(s) is of importance. Furthermore, the belt portions should not be separated too much in the sleeves but rather the surfaces outside should abut.

The locking passages of the sleeves have shoulder or other closure means at one end to prevent incorrect insertion in the wrong direction whilst otherwise are of the same dimension as the sliding passage. It will be appreciated that whilst free sliding of the belt when in flat straight condition is possible, very little clearance should exist so that with sufficient overlapping of the belt in the annulus, sufficient curvature occurs as to increase the frictional effect of the band portions in contact with each other and with the sliding passage(s) surfaces and/or of the inclination of the belt in the sliding passages of the sleeves and/or tilting of the sleeves by the free ends of the belt as a result of their location so as to produce the necessary self-locking or temporary jamming in the operative position and diameter. Preferably the material of the belt is polypropylene whilst that of the sleeves is plastics material such as nylon. The belt material is to be sufficiently resilient as well as flexible whilst being sufficiently stiff as to be self-supporting when held at one edge and when the bag is being filled.

The exterior surfaces of the sleeves should be smooth and all corners rounded so as to be streamlined and thus not snag or tear the bag material i.e. to permit sliding against the bag in the operative position. The pressure of the belt against the walls of the sliding passages as a result of the resilient effect of the belt material is of significant effect also.

The walls of the sleeves against which the belt portions abut in the locking position of use are sufficiently stiff as not to be deformed and thus act to restrain sliding movement of the belt in the locking condition. Each sleeve is preferably provided with a central dividing wall defining a sliding through-passage for the belt and a locating recess for the belt end with belt end engaging means preferably integrally formed of plastics material.

The invention will be described further by way of example, with reference to the accompanying drawings, in which.

Figure 11A:
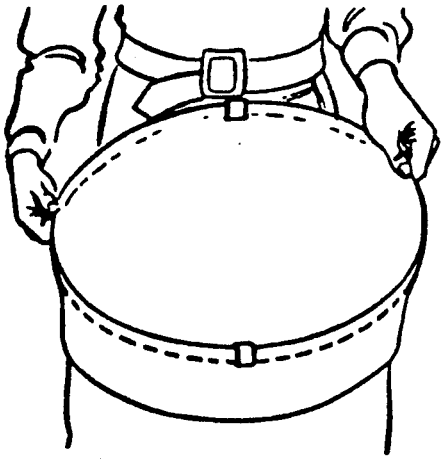
Figure 11B:
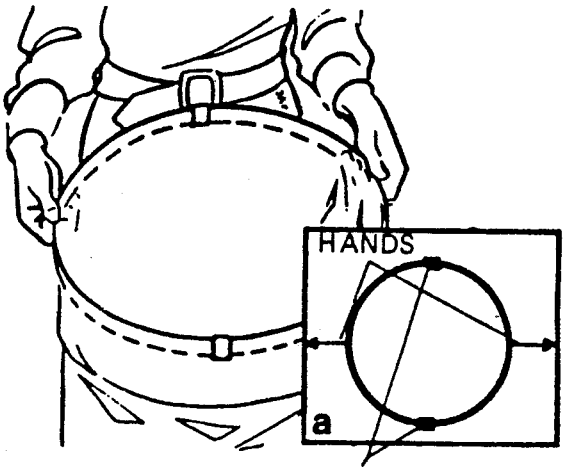
Figure 11C:
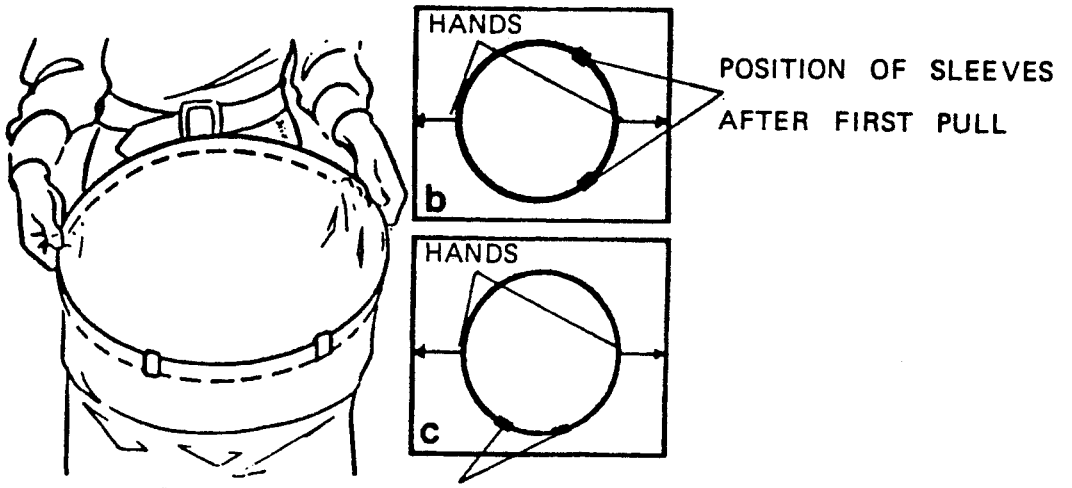
Figure 12:
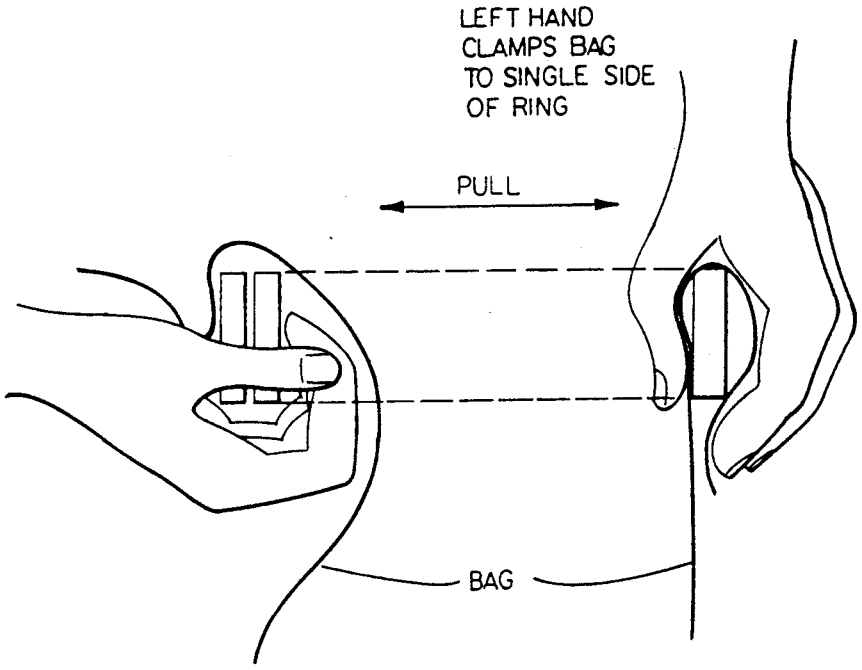
Figure 13:
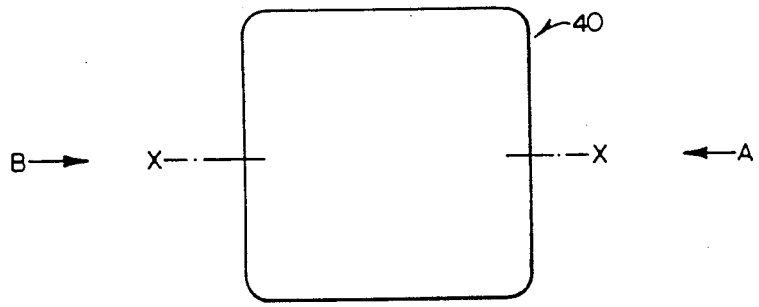
Figure 14:
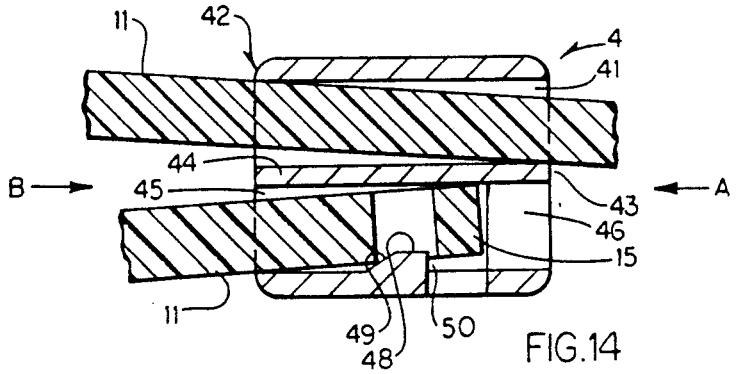
Figure 15:
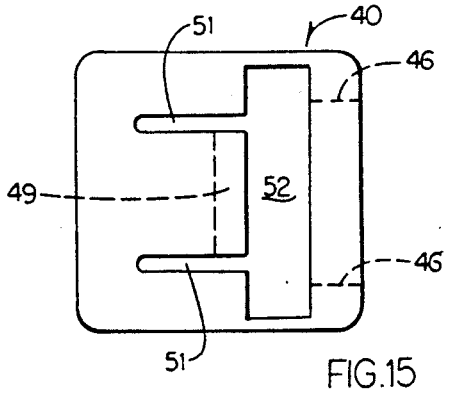
Figure 16:
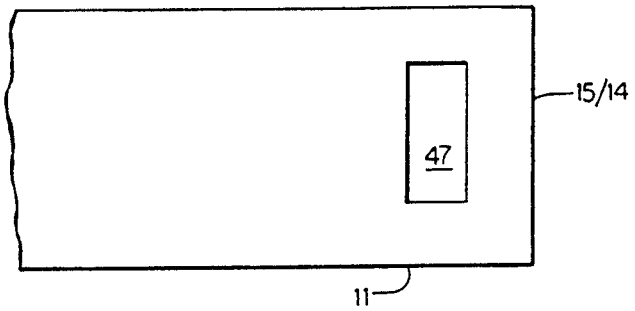
Figure 17:
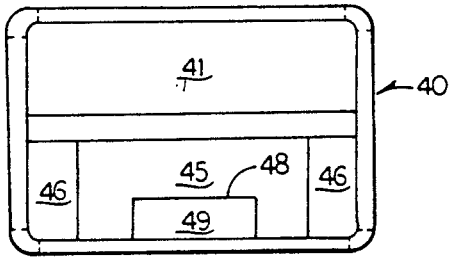
Figure 18:
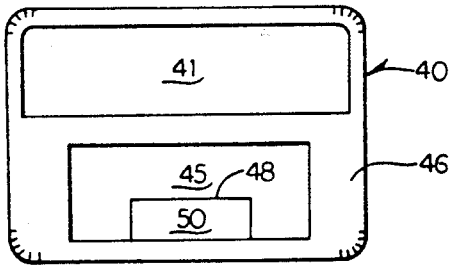

FIGS. 11*a*, 11*b* and 11*c* show various operational stages in the method of use;

FIG. 12 is a schematic illustration of an operational technique;

FIG. 13 is a plan view of a preferred form of sleeve;

FIG. 14 is a cross section on the line X—X of FIG. 13;

FIG. 15 is an inverted plan of the sleeve of FIG. 13;

FIG. 16 is a plan view of an end of the belt for use with the sleeve in FIGS. 13–15;

FIG. 17 is an end elevation from the direction of arrow A of FIGS. 13 and 14; and FIG. 18 is an elevation from the direction of arrow B.

In accordance with the invention a loop device 10 (FIG. 2) for holding open the mouth of a bag comprises an elongate belt 11 wound to form an annulus (annular member or body) as shown, and sleeves 12 and 13 retaining the belt 11 in this annular position and configuration.

Figure 1:
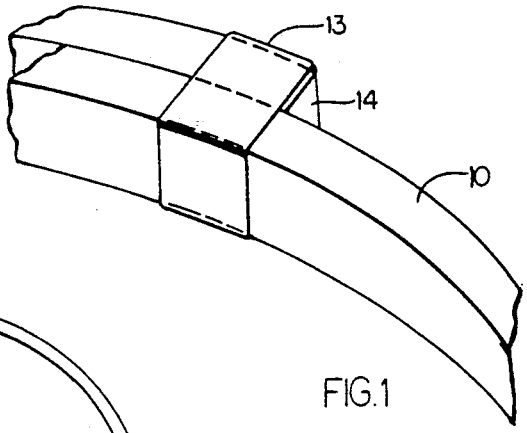
FIG. 1 is a perspective view of part of a loop device showing a free end of a belt and sleeve of FIG. 2 on an enlarged scale.
Figure 2:
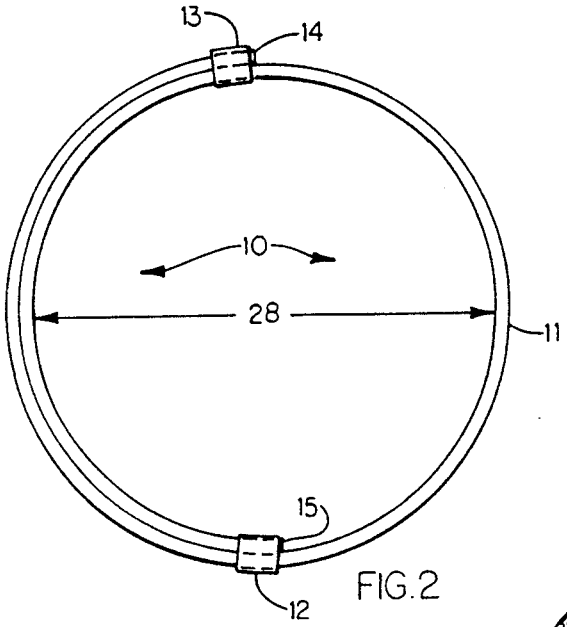
FIG. 2 is a plan view of a device for holding the mouth of a bag open and forming an embodiment of the invention.

The annulus is formed, for example, by firstly sliding first sleeve 12 onto the belt 11 via first end 14 and then mounting the second sleeve 13 on the first end 14 of the belt 11. The second end 15 of the belt 11 is then threaded firstly through the sleeve 13 and thence into sleeve 12 to be secured therein causing the belt 11 to form the annulus (annular body) as shown in FIG. 2, the first sleeve 12 and second sleeve 13 are respectively engaged by the second end 15 and first end 14.

The diameter of the annulus may be varied, and may be increased, for example, by sliding end 14 and sleeve 13 anti-clockwise along the belt 11 with respect to end 15 and sleeve 12. In a similar fashion, the annulus may be decreased by sliding the end 15 and sleeve 12 in the opposite direction to that above. The belt 11 is approximately 2 meters long by 25 mm by 3–5 mm thick and is constructed from plastic such as polypropylene or spring steel and any material which will serve the purpose.

Figure 3:
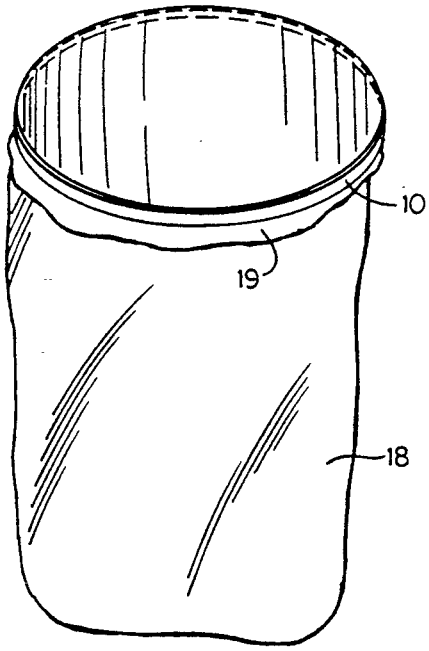
FIG. 3 is a perspective view of the device of FIG. 2 in position of use retaining open the mouth of the bag.

As shown schematically in FIG. 3, the mouth of the plastics material bin bag or any type of bag 18 is pulled up through the loop device 10 and left to overhang 19 by about 3 to 4 inches. In use, the mouth of the bag is now stretched by increasing the diameter of the loop device 10 by hand pressure in the directions 28 (FIG. 2) and the bag mouth will now remain open for depositing materials therein.

Figure 4:
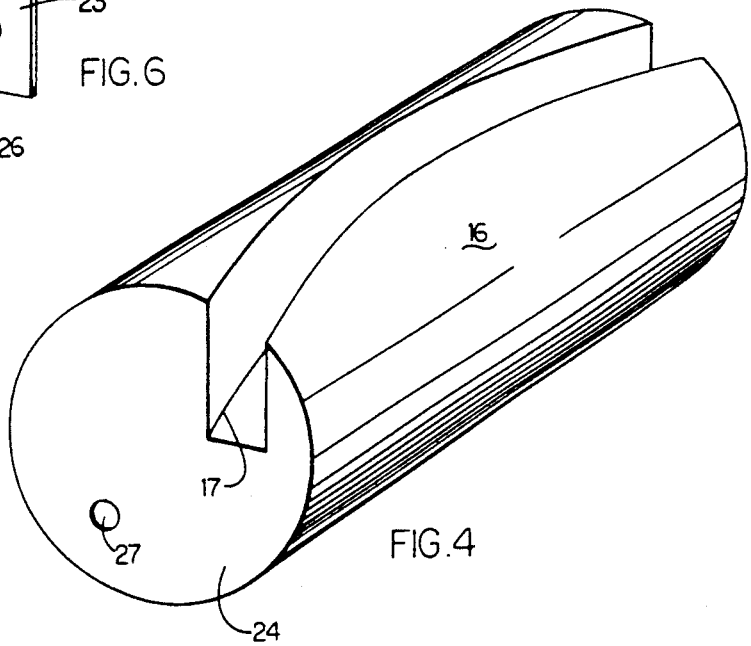
FIG. 4 is a perspective view of a plastics cylinder having a longitudinal slot and which acts as a handle and base for the loop device.
Figure 5:
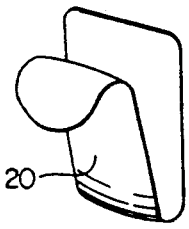
FIG. 5 is a perspective view of a clip for additionally securing the bag to the loop.

To give a more comfortable hand grip a rubber or plastic handle 16 (FIG. 4) is provided, which is cylindrical and has a curved slot 17 running along its length into which a portion of the loop device 10 tightly fits. As shown in FIG. 3, the mouth of a bag 18 is pulled through the loop device and stretched over the device 10 and the device is then increased in diameter by pressure in directions 28 (FIG. 2). The device 10 will then be self-retaining in this larger diameter. For bags which do not stretch easily a clip or clips 20 (FIG. 5) are used to fix the bag 18 to the loop device 10.

Figure 7A:
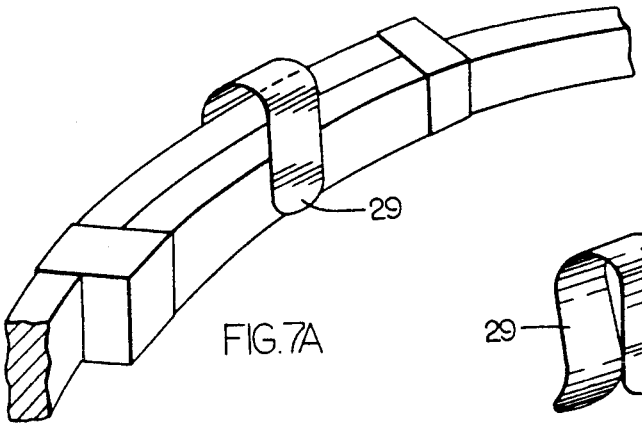
FIGS. 7A and 7B is a perspective view of a further clip which may help to retain the elongate annular member in a tensioned diameter whilst the bag is fitted.
Figure 7B:
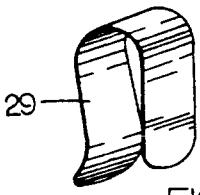

For most bags the increased diameter will cause the bag to cling to the loop device 10 and the device will be self-retaining in its largest diameter, but the retention of the larger stretched diameter i.e. when the bag is completely fitted may be facilitated by use of the spring clip 29 (FIG. 7). The mouth of the bag 18 remains open for depositing materials therein, and can be gripped by the handle 16 and transported as required.

Figure 6:
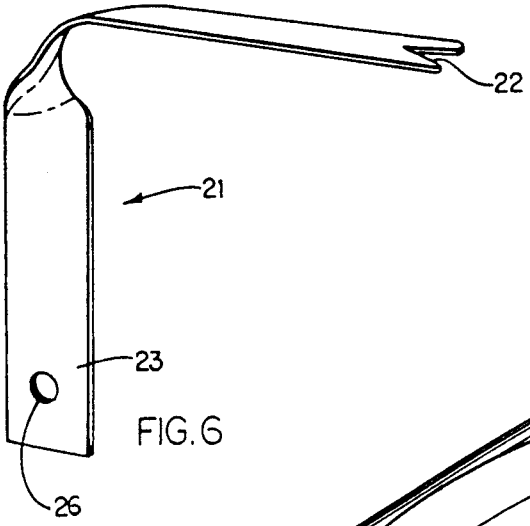
FIG. 6 is a perspective view of a discharge member comprising a twisted strip with a notch and which facilities the removal of matter from a separate, hand-held spike (not shown)

The open bin bag 18 (FIG. 3) is ideally adapted for use with a spike (not shown) for spearing paper. An arm 21 (FIG. 6) forming a discharge member is provided with a notch 22 so that paper on a spike can be released by pulling the spike along the notch 22.

The arm 21 is formed from a strip, the base 23 of which lies flush with one end of the handle 24 and is fixed thereto by a screw 25 through holes 26 and 27. From the flush base 23, the arm twists so as to extend radially inwards over the open bag mouth and presents the notch 22 for use with the spike.

Figure 8A:
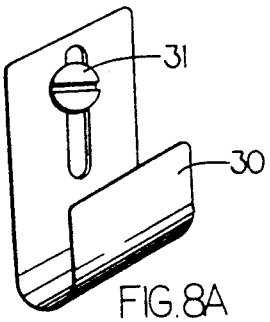
FIGS. 8A and 8B is a perspective view of a wall clip and pole clip as alternative support devices for the loop device and bag
Figure 8B:
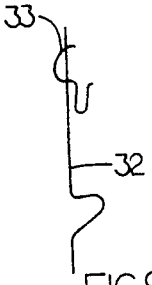
Figure 8C:
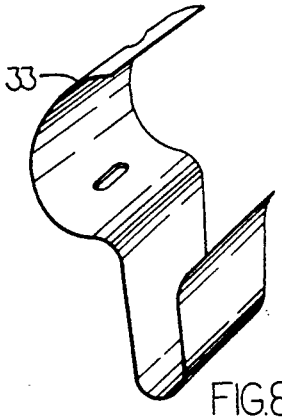
FIG. 8C is a schematic elevation view of the pole clip as used on a pole.
Figure 9:
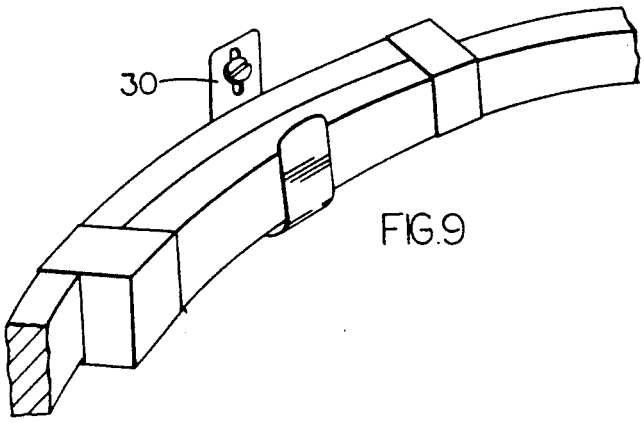
FIG. 9 is a fragmentary perspective view of an elongate annular member when it is fitted to the wall clip of FIG. 8.

The loop device 10 may be held against a vertical surface before or after the bag is fitted, by means of an adjustable clip 30. (FIG. 8). The loop device 10 sits in this clip as illustrated in FIG. 9. The height of the loop device 10 from the floor or ground may be adjusted by the screw and slot mechanism 31. The loop device 10 may be held against a vertical pole 32 (FIG. 8) which has a pointed lower end and is partially pushed into the ground. The method of holding the annular body on the pole is by a spring clip 33 (FIG. 8) and is the same method as that of it being held in the clip 30 as shown in FIG. 9. The clip may be adjusted with reference to its position on the pole and thereby adjusting the height of the loop device 10 from the ground or floor, by hand pressure being applied to the surfaces of the clip.

Figures 10A, 10B:
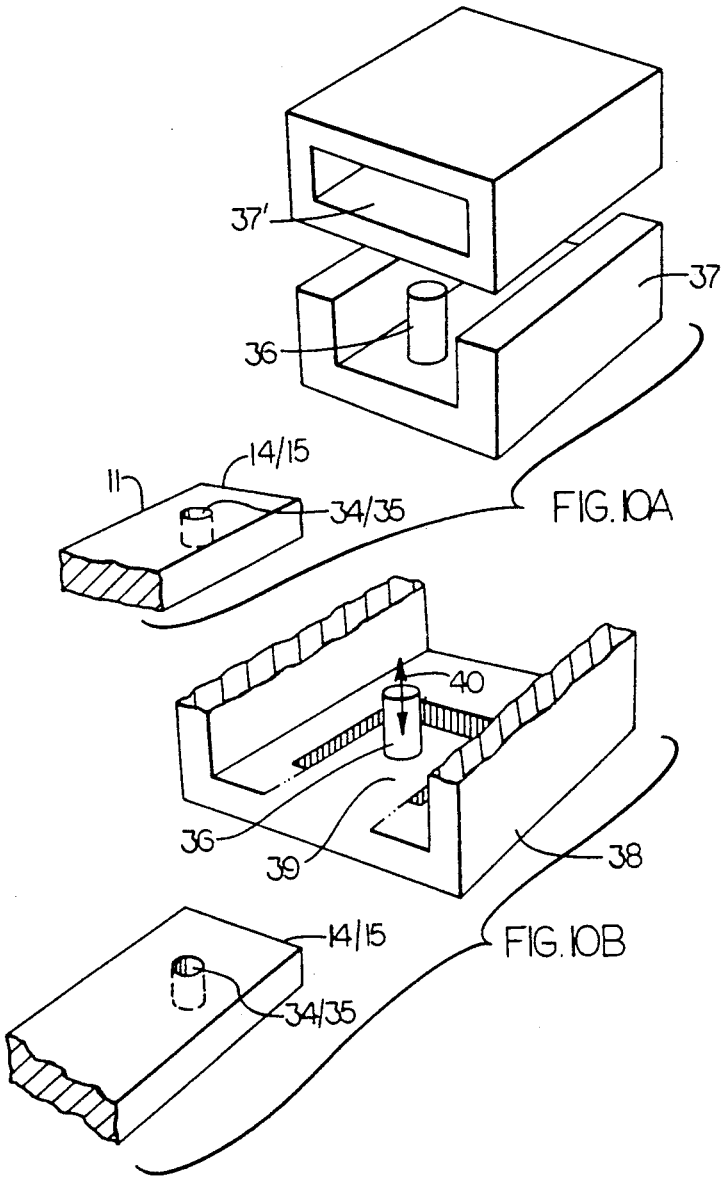
FIGS. 10A and 10B illustrate the device and method for securing the sleeves to the ends of the elongate annular member band.

FIG. 10 illustrates methods by which the sleeves 12 and 13 may be fitted to the ends of the elongate belt 11. The elongate belt 11 has a hole 34 and 35 at either end 14 and 15. A projection or stud 36 is provided in the inside of each sleeve 12 or 13 and are designed to engage in the holes 34, 35 and when doing so preventing the sleeve from separating from the elongate belt 11. The stud can either be engaged by using a sleeve as 37 where there is a horizontal split, and both the top and bottom come together to envelope the elongate belt 11 or by using a sleeve as 38 (only bottom section of the sleeve is shown and is sectioned in the horizontal plane) where the elongate belt is pushed horizontally through the sleeve and the stud 36 is on a flexible strip 39 which will move up and down to let the belt engage into the spud, the stud engaging when pressure is applied to force the belt through the sleeve. The vertical movement of the flexible strip on which the spud is mounted is shown by the arrow 40. Sleeve type 38 may be integrally formed with the sliding-through passage for the belt (not shown). Both sleeve type 37 and 38 are self-locking and permanent. An 'eye' may be moulded on the sleeve of either type so as to enable the spring 20 or 29 to be attached to the loop device 10 by means of a cord. The 'eye' is not shown.

Through passages are provided in each sleeve (12, 13) (37, 38) for the through sliding of portions of the belt 11 intermediate the ends (14, 15). Each sleeve also has a recess or passage for receiving an end 14, 15 of the belt 11 which in FIG. 2 the passages are on the outer side of the annulus for end 14 and on the inner side for end 15. The sleeves are shaped and dimensioned so as to permit the sliding relative to the bag material without jamming or damaging such.

The method of combining a loop device with the mouth of a plastics material bag is amplified in FIGS. 11*a*–11*c* and FIG. 12 and the stages might be listed as follows:

1. Open out bag and expand loop device or ring 10 until diameter is slightly smaller than bag mouth diameter.

2. Noting the sleeve positions on ring, bring bag up through, and fold over ring, giving a minimum overlap of 5"–6".

3. Noting sleeve positions, put fingers of both hands up below ring 10, as FIGS. 11*a*–11*c* show, and pull ring to expand. (It is important that pull is in the correct direction—relative to sleeve positions).

4. Turn ring with bag fitted 90 degrees and pull to expand ring again. Ring will now firmly grip the bag. Whilst the device may be used with advantage simply inside the mouth of a bag with the periphery folded inwards the preferred arrangement of the bag extending through the annulus formed by the device and the periphery of the mouth being folded outwardly over and downardly provides exceptional advantages as regards location and operation and ease of use. The slight deformation or stretching of the folded over portion when the device is expanded thereagainst enhances the gripping action and provides exceptional advantages.

A further preferred embodiment of loop device of the invention is illustrated in FIGS. 13 to 18 and is similar to that of FIG. 2 and is for use with a polythene bin bag having a diameter of approximately 65.5 cm, the belt is flat being 182 cm long, 2.6 cm wide (actually 1 inch wide), is 0.5 cm (3/6") thick and of generally rectangular cross section. The sleeves are dimensioned approximately 3.2 cm (1¼") by 3.2 cm (1½") by 1.75 cm (¾") deep. The sleeves are identical but oppositely and reversely disposed in use and have sliding or through passages in which the belt slides are 3.1 cm (1¼") long, 2.7 cm (11/16") wide and 0.6 cm (¼") deep. In the sleeves, the separating wall between the belt portions is 2.5 mm (1/16"). In use with the loop device holding the bag mouth open, the device has an approximate 137.1 cm. (4'6") circumference with adjacent edges of the sleeves being spaced at 15.85 cm (6¼") measured circumferentially over the overlapped portion of the belt. The opposite edges are spaced at 83.8 cm (2'9") circumferentially over the non-overlapping belt portion. The loop device does not appear to start self-locking until the adjacent sleeve edges are approximately 25.4 cm (10") apart circumferentially over the overlapping part of the annulus.

In FIGS. 13 to 18 a preferred embodiment of sleeve is illustrated comprising two identical moulded plastics members 40 (only one shown) each having a through passage 41 for sliding of belt 11 which are dimensioned relative to each other so that as the loop diameter decreases and the inner end 15 of belt 11 pivots and tilts sleeve 40, the upper run of belt 11 becomes inclined relative to the longitudinal axis of the passage 40 (exaggerated in FIG. 14) so that jamming or "automatic partial locking" occurs especially at edges 42, 43 sufficient to prevent collapsing of the loop by the pressure of the bag acting thereagainst but such that special manipulation readily removes the jamming effect.

A lower passage 45, has a shoulder or reduced cross sectional portion 46 at one end which prevents the end of belt 11 passing through and enables the projection 47 which is supported by an arm 48 made so as to be resiliently flexible by side slits 49 and an end slot 50 so that when there is inserted the end of belt 11 which has a cooperating aperture therein, such deflects slightly and then springs-back to retain the end in position by virtue of the shaping of of a ramp like portion of triangular cross-section.

The external edges and corners of the sleeves 40 are rounded or "streamlined" to slide relative to the bag material without damaging such or jamming.

Each sleeve 40 has a central dividing wall 44 and lower, locating passage 45 which has a reduced cross-sectional area at one end 46 as a stop for belt end 15 which is identical to outwardly located belt end 14 (see FIG. 2) in that it is in this arrangement provided with a rectangular through passage 47 which is engageable with a resiliently mounted ratchet-like, retaining projection 48 in passage 45. Projection 48 is formed by a ramp-like portion in the passage 45 with an inclined surface 49 and a perpendicular face 50 which locates in passage 47 of belt 11. The projection 48 is resiliently displaceable by having two slots 51 formed either side leading to passage 52 so that the resilience of the material of sleeve 40 may become effective because of the weakening thereby.

As will be apparent from FIG. 14 the other end 14 of belt 11 has an identical sleeve 40 located thereon but in inverted and reversed disposition so that belt 11 is oppositely inclined and jams against edges opposite to edges 42, 43.

Various modifications may be made without departing from the present invention. For example partial self-jamming or locking to resist the compressive forces of the bag material etc. in use may be achieved by toothing on the belt and ratchet-like members in the sleeves (or vice versa) or other manually operable securing and release means may be provided such as to be operable when the bag material is folded over the device and through the material and such as not to damage or jam with the bag material in use e.g. a double acting push button area with belt securing and release action operable through the material may be used.

As a minor modification, the belt and sleeves may have a curved or arcuate cross-section so as to provide an outwardly facing channel in which a rubber or other elastic band or belt may be located stretched to hold the bag, folded thereover, in position on the annulus or ring. Also, of different inventive concept, is a similar but non-adjustable ring of curved cross-section or other shape to hold an elastic ring in position and substantially of a diameter over which the bag mouth may just be folded to be held in position by the elastic ring—suitable clips and supports may be provided as desired.

In FIG. 12, the fingers of the right-hand are placed between the ring and bag and pull on the double side of the ring. It is of considerable importance for the device according to the present invention to have the ability or capability to expand after the bag mouth has been wrapped over it.

I claim:

1. A device to retain the mouth of a bag open comprising:

an elongated belt having sufficient flexibility to bend over on itself to form a ring with radial inner and outer opposite sides and with both ends of the belt overlapping each other, and being of sufficient stiffness to be self-containing or self-supporting in any variation of ring diameter, and two holding means for releasably and engageably holding an end adjustably to the belt;

the holding means are provided each in the form of a sleeve one at each end of the belt and each is such that, with the periphery of the mouth of the bag folded over the annular member, the diameter of the ring can be varied after the mouth of the bag is folded thereover by moving at least one end along the belt relative to the other end to expand the ring to press against the bag such that the material thereof stretches and grips the ring, the mouth of the bag being circumferentially held by said ring in a position of adjustment by securing means of the sleeve;

each of said sleeves having a belt end retaining portion and a through passage with a surface portion between said retaining portion and said through passage, one end of said belt connected within said retaining portion, an intermediate portion of said belt is held in said through passage adjacent to one end of said belt, said intermediate portion of said belt being held slidable in said through passage, the relative shaping and dimensioning of the belt and said through passage being such that said intermediate portion is securable in said through passage when the expanded condition of use of said belt causes a resultant reactive pressure between said intermediate portion of said belt and said through passage as said intermediate portion of said belt is tilted within said through passage to frictionally restrict movement of said belt sufficiently to prevent reduction in diameter of said belt by said bag.

* * * * *